US005237372A

United States Patent [19]

Ishii et al.

[11] Patent Number: 5,237,372

[45] Date of Patent: Aug. 17, 1993

[54] TONER QUANTITY DETECTING SYSTEM FOR AN IMAGE RECORDING APPARATUS, A METHOD OF DETECTING THE QUANTITY OF TONER AND A DEVELOPING DEVICE FOR THE IMAGE RECORDING APPARATUS

[75] Inventors: Masato Ishii; Masanori Tokuhisa, both of Kawasaki, Japan

[73] Assignee: Fujitsu Limited, Kawasaki, Japan

[21] Appl. No.: 857,514

[22] Filed: Mar. 25, 1992

[30] Foreign Application Priority Data

Mar. 29, 1991 [JP] Japan ..... 3-65135
Mar. 29, 1991 [JP] Japan ..... 3-65136

[51] Int. Cl.[5] ..... G03G 21/00
[52] U.S. Cl. ..... 355/246; 355/208
[58] Field of Search ..... 355/203, 204, 205, 206, 355/207, 208, 209, 245, 246, 260

[56] References Cited

U.S. PATENT DOCUMENTS 4,739,365 4/1988 Hino ..... 355/246
4,932,356 6/1990 Watanabe et al. ..... 355/208 X
5,035,198 7/1991 Niito ..... 355/208 X
5,036,363 7/1991 Iida et al. ..... 355/246
5,075,726 12/1991 Itaya et al. ..... 355/246
5,091,749 2/1992 Iida et al. ..... 355/246

FOREIGN PATENT DOCUMENTS 63-49569 4/1988 Japan .
64-4778 1/1989 Japan .
64-57282 3/1989 Japan .
1-186982 7/1989 Japan .
2-216167 8/1990 Japan .

*Primary Examiner*—A. T. Grimley
*Assistant Examiner*—Sandra L. Brase
*Attorney, Agent, or Firm*—Staas & Halsey

[57] ABSTRACT

A toner quantity detecting system has a toner quantity detector (4c) and is capable of accurately detecting the decrease of the quantity of toner contained in the toner container of the developing unit of an image recording apparatus to an upper threshold quantity and to a lower threshold quantity regardless of the inherent output characteristic of the toner quantity detector (4c) and determining a prewarning voltage ($E_{nep}$) representing the upper threshold quantity and a warning voltage ($E_{emp}$) representing the lower threshold quantity so that the difference between the prewarning voltage ($E_{nep}$) and the warning voltage ($E_{emp}$) is sufficiently large. The prewarning voltage ($E_{nep}$) and the warning voltage ($E_{emp}$) are determined on the basis of the inherent output characteristic of the toner quantity detector (4c). The output voltage ($E_s$) of the toner quantity detector (4c) is compared with the prewarning voltage ($E_{nep}$) and the warning voltage ($E_{emp}$) to provide a prewarning signal (NAL) upon the reduction of the quantity of the toner to the upper threshold quantity and to provide a warning signal (EAL) upon the reduction of the quantity of the toner to the lower threshold quantity.

10 Claims, 15 Drawing Sheets

TONER QUANTITY DETECTING SYSTEM FOR AN IMAGE RECORDING APPARATUS, A METHOD OF DETECTING THE QUANTITY OF TONER AND A DEVELOPING DEVICE FOR THE IMAGE RECORDING APPARATUS

BACKGROUND OF THE INVENTION

1. Field of the Invention

The present invention relates to a method of detecting the quantity of toner and, more particularly, to a method of detecting the quantity of toner in an image recording apparatus, capable of detecting the exhaustion and virtual exhaustion of toner, i.e., residual amount of toner in the storage on the basis of the output voltage of a toner quantity detector provided on the outer surface of the casing of a toner storage unit or a toner stirring unit.

2. Description of the Prior Art

An electrophotographic printer or a copying machine first forms an electrostatic latent image of the original document to be copied or printed on a photoconductive drum; thereafter prints or copies it by developing the electrostatic latent image formed by a toner transferring the toner image to a recording sheet and fixing the toner image on the recording sheet. FIG. 7 shows such an electrophotographic printer. The electrophotographic printer has a photoconductive drum 1, a charger 2 for charging the entire circumference of the photoconductive drum in a uniform potential, and a scanning unit 3 for longitudinally scanning the circumference of the photoconductive drum 1, (in the main scanning direction,) with a laser beam RB emitted by a laser diode, not shown, a developing unit 4 for developing the electrostatic latent image with toner, a transfer charger 5 for transferring the toner image to the recording sheet, a fixing unit 6 for fixing the toner image on the recording sheet, and a sheet transporting passage 7.

The scanning unit 3 comprises a polygonal rotating mirror 3*a*, an f$\theta$ lens 3*b*, a mirror 3*c* and a cylindrical lens 3*d*. During the scanning operation, the laser beam RB is turned on and off according to image data to form an electrostatic latent image on the photoconductive drum 1.

As shown in FIG. 8, the developing unit 4 comprises a toner stirring unit 4*a* for frictionally charging toner TN by stirring toner TN with a toner stirring member 4*a*-1, a toner feeder 4*b* and a toner quantity detector 4*c* for detecting the quantity of toner TN remaining in the developing unit 4. The toner TN is stirred by the toner stirrer 4*a*-1 and the frictionally charged toner TN is fed to a rotating magnet roller 4*b*-1 included in the toner feeder 4*b*. Surplus toner TN is scraped off with a doctor's blade 4*b*-2 to form a toner layer of toner TN in a predetermined thickness on the circumference of the magnet roller 4*b*-1 so that the toner layer touches the circumference of the photoconductive drum 1. A bias voltage is applied between the magnet roller 4*b*-1 and the photoconductive drum 1. The toner TN is transferred from the magnet roller 4*b*-1 to the electrostatic latent image formed on the circumference of the photoconductive drum 1 by the agency of the potential difference between the magnet roller 4*b*-1 and the photoconductive drum 1 to develop the electrostatic latent image in a toner image.

As shown in FIG. 9(*a*), the toner quantity detector 4*c* is placed fixedly in contact with a detector seat 4*a*-3, for mounting the sensor thereat formed on a frame 4*a*-2 of the developing unit 4 to detect the quantity of toner TN remaining in the developing unit 4. Since it is impossible to print a sharp image on a recording sheet if the quantity of toner TN in the developing unit 4 decreases excessively during operation, the quantity of toner TN is detected by the toner quantity detector 4*c* during operation and, if necessary, a warning is given to prompt the operator to replenish the developing unit 4 with toner or to replace the developing unit with another.

As shown in FIG. 9(*b*), the toner quantity detector 4*c* is of a differential transformer construction comprising a driving coil L1, a reference coil L2 and a detecting coil L3, which are mounted on a core. A high-frequency signal of 500 kHz is applied to the driving coil L1.

A developer, in general, is a mixture of a small amount of magnetic carrier particles and a magnetic toner. As toner is consumed, the magnetic resistance of the toner varies according to an upper level of the developer relative to the position of the toner quantity detector 4*c*, whether the upper level of which remains above a surface defined by the detector 4C or below the surface thereof or near the surface thereof and hence the output voltage of the detecting coil L3 varies with the variation of the level of the developer as shown in FIG. 9(*c*). That is, the output voltage of the toner quantity detector 4*c* remains constant on a high level while the quantity of toner is greater than a threshold quantity. When the quantity of toner decreases below the threshold quantity, the output voltage of the toner quantity detector 4*c* starts falling, and the output voltage of the toner quantity detector 4*c* settles at a low level after the toner has almost been exhausted.

A prewarning voltage $E_{nep}$ corresponding to a state where the toner is nearly exhausted or a warning voltage $E_{emp}$ corresponding to a state where the toner is virtually exhausted and is set or both the prewarning voltage $E_{nep}$ and the warning voltage $E_{emp}$ are set, the output voltage $E_s$ of the toner quantity detector 4*c* is compared with the prewarning voltage $E_{nep}$ and the warning voltage $E_{emp}$ to detect if the quantity of the toner has decreased below a predetermined quantity or if the toner has virtually been exhausted, and identifies the condition by an alarm.

The electrophotographic apparatus of such a construction uses a single-component developer comprising only a toner made of carbon particle containing a magnetic component therein, a two-component developer containing a nonmagnetic container and a magnetic carrier, or a two-component developer containing a small amount of magnetic carrier and a magnetic toner.

Incidentally, the output characteristic of the toner quantity detector is not constant due to a variation of the adjusting operation thereof and the sensitivity thereof. The variation of the adjustment is developed when an output of a magnetic resistance sensor portion of the detector is adjusted with a variable care.

Accordingly, the output characteristic of the toner quantity detector is represented by:

(1) a curve A (FIG. 10) when the variation of the sensitivity thereof is maximum and the variation of the the adjusting operation is maximum, (2) a curve B (FIG. 10) when the variation of the sensitivity thereof is maximum and the variation of the adjusting operation is minimum, (3) a curve C (FIG. 10) when the variation of the sensitivity thereof is minimum and the variation of the adjusting operation is maximum or (4) a curve D (FIG. 10) when variation of the sensitivity from the standard is small and the variation of the adjusting operation is minimum.

If the output characteristic of the toner quantity detector varies according to the sensitivity and the condition of adjustment, the actual quantity of toner corresponding to the prewarning voltage $E_{nep}$ and that of the toner corresponding to the warning voltage $E_{emp}$ vary widely depending on the output characteristics represented by the output characteristic curves A, B, C and D. Accordingly, the number of copies that can be produced before the toner quantity detector provides an output voltage $E_s$ corresponding to the warning voltage $E_{emp}$ varies depending on the output characteristic of the toner quantity detector.

Therefore, all the possible output characteristics of the toner quantity detector must be taken into consideration in determining the prewarning voltage $E_{nep}$ and the warning voltage $E_{emp}$; that is, the prewarning voltage $E_{nep}$ must be set at a level below a voltage E1 defined by the output characteristic curve D, in which both variations of sensitivity and adjusting operation and minimum and the warning voltage $E_{emp}$ must be set at a level higher than a voltage E2 defined by the output characteristic curves A and C in which the adjusting operation thereof is maximum. If the prewarning voltage $E_{nep}$ and the warning voltage $E_{emp}$ are determined in such a manner, the difference between the prewarning voltage $E_{nep}$ and the warning voltage $E_{emp}$ is small, and hence the toner quantity detector will provide the warning voltage $E_{emp}$ in a very short time after providing the prewarning voltage $E_{nep}$, so that only a very short time is available for preparing a supply toner after a prewarning has been given before a warning prompting the operator to replenish the developing unit with toner is given. If the operator is unable to prepare the supply toner before the warning is given, the operation of the electrophotographic apparatus must be interrupted.

Although toner quantity detectors have different output characteristics respectively due to errors in the toner quantity detector manufacturing processes and in the quality of the component parts, the toner quantity detectors are adjusted uniformly by a standardized adjusting method after mounting the toner quantity detectors respectively on electrophotographic apparatus before shipping the electrophotographic apparatus. Accordingly, it has been the present status of art that the output voltage $E_s$ of the toner quantity detector does not necessarily represent the accurate quantity of toner remaining in the developing unit.

As is obvious from FIG. 10, although the difference between the output voltages $E_s$ of the toner quantity detectors having different output characteristics near the warning voltage $E_{emp}$ is relatively small, the output voltages $E_s$ change sharply in greatly different modes from the upper output voltages above the prewarning voltage $E_{nep}$ to the lower output voltages near the warning voltage $E_{emp}$, respectively. Thus, the mode of change of the output voltage $E_s$ from the upper output voltage to the lower output voltage is dependent on the inherent output characteristic of each toner quantity detector. Accordingly, the output characteristic of the toner quantity detector must be measured accurately to determine accurately the quantities of toner respectively corresponding to the prewarning voltage $E_{nep}$ and the warning voltage $E_{emp}$ of the toner quantity detector.

SUMMARY OF THE INVENTION

Accordingly, it is an object of the present invention to provide a method of detecting the residual quantity of toner capable of suppressing the variation thereof at a time when the prewarning voltage $E_{nep}$ and/or warning voltage $E_{emp}$ is generated by a toner quantity detector even when the output voltage characteristic of the detector is not constant due to the variations of the sensitivity and the adjusting operation being still remaining.

Another object of the present invention is to provide a method of detecting the quantity of toner capable of securing a sufficiently long time between the detection of the decrease of the quantity of toner to a prewarning level and the detection of the decrease of the same to a warning level.

A further object of the present invention is to provide a method of detecting the quantity of toner capable of facilitating the setting of a prewarning voltage and a warning voltage.

To achieve the objects, the present invention provides a toner quantity detecting means for an image recording apparatus comprising: a photoconductive drum; a charging means for charging the circumference of the photoconductive drum; an electrostatic latent image forming means for forming an electrostatic latent image on the circumference of the photoconductive drum; a developing means for developing the electrostatic latent image formed on the circumference of the photoconductive drum with a toner in a toner image, (having a toner storage unit or a toner stirring unit, at least either the toner storage unit or the toner stirring unit being detachably mounted on the main frame of the image recording apparatus;) a transfer charging means for transferring the toner image to a recording medium; and a fixing means for fixing the toner image to the recording medium; said toner quantity detecting means comprising: a toner quantity detector, held on an outer surface of the toner container of either the toner storage unit or the toner stirring unit and in contact with a predetermined portion of the main frame of the apparatus; an output characteristic determining means for determining the inherent output characteristic of the toner quantity detector by setting a threshold voltages determining a prewarning voltage and a warning voltage for the toner quantity detector; an AD converter for converting the analog output signal of the toner quantity detector into a proportional digital signal; and comparing means for comparing the output signal of the AD converter with the prewarning voltage and the warning voltage to determine the current quantitative condition of the toner.

In another aspect of the present invention, the detecting characteristics determining means of the toner quantity detecting means comprises, at least, as principal components, a measuring means for measuring the output characteristic of the toner quantity detector, a storage means for storing the measured output characteristic of the toner quantity detector, a predetermined value storage means for setting and storing a predetermined value S1 and a predetermined value S2 greater than the value S1, a storage means for storing the sum of the value S1 and the minimum and stable voltage output from the toner quantity detector in accordance with the output characteristic curve thereof and the sum of the value S2 and the minimum and stable voltage output from the toner quantity detector in accordance with the output characteristic curve thereof, and a storage means for storing the sum of the minimum and stable voltage output from the toner quantity detector and the value S1 as a warning voltage for the threshold voltage for the warning voltage of the detector and the sum of the minimum and stable voltage output from the toner quantity detector and the value S2 as a theeshold voltage for the prewarning voltage thereof.

BRIEF DESCRIPTION OF THE DRAWINGS

The above and other objects, features and advantages of the present invention will become more apparent from the following description in connection with the accompanying drawings, in which.

DETAILED DESCRIPTION OF THE PREFERRED EMBODIMENTS

Figure 1A:
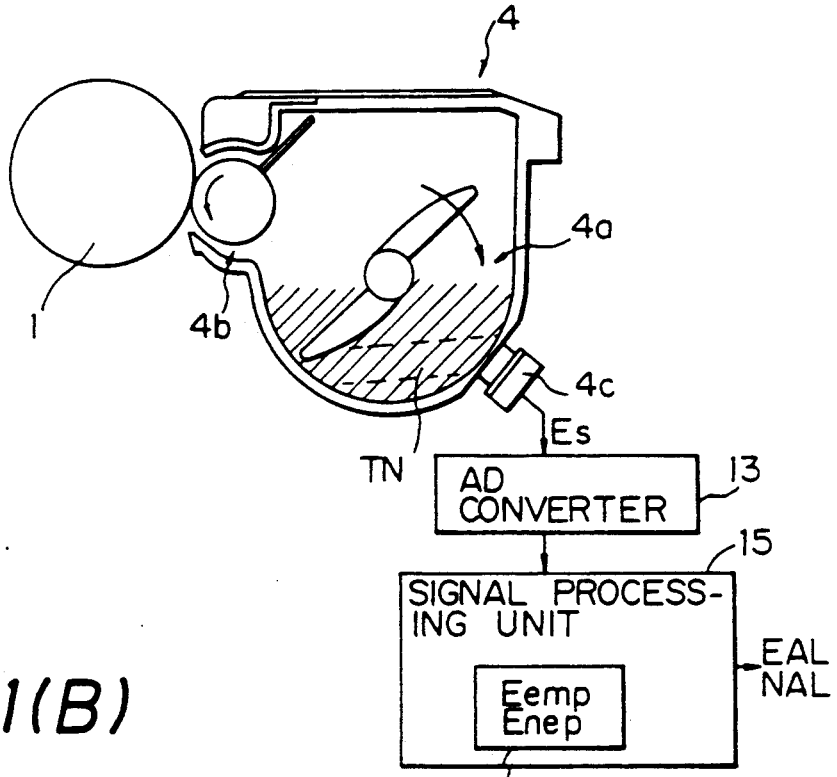
FIGS. 1(*a*) and 1(*b*) are a schematic sectional view and a graph, respectively, explaining a principle on which the present invention is based.
Figure 1B:
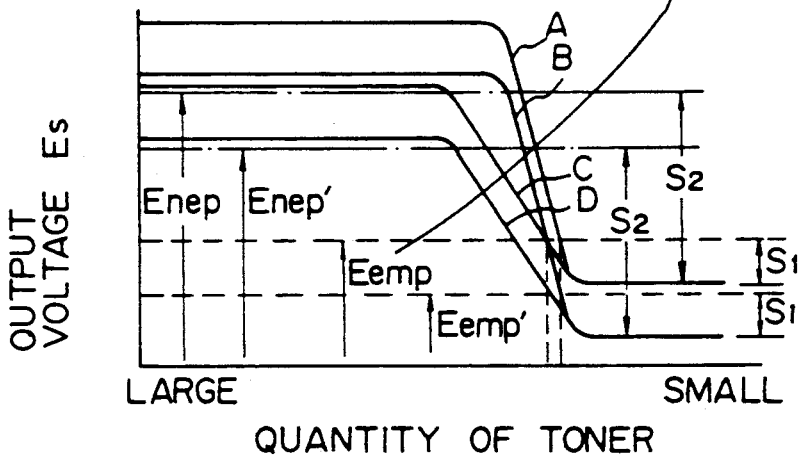

Referring to FIG. 1(*a*), there are shown a photoconductive drum 1, a developing unit 4, a toner stirring unit 4*a*, a toner feeder 4*b*, a toner quantity detector 4*c*, an AD converter 13 for converting the output voltage of the toner quantity detector 4*c* to a proportional digital signal, and a signal processing unit 15 for setting a prewarning voltage $E_{nep}$ and a warning voltage $E_{emp}$ and for controlling and monitoring the quantity of toner.

The signal processing unit 15 is set, taking into consideration the output characteristic of the toner quantity detector 4*c*, for a warning voltage $E_{emp}$ ($E_{emp}'$) representing the virtual exhaustion of toner below a predetermined lower limit and a prewarning voltage $E_{nep}$ ($E_{nep}'$) representing a decrease of the quantity of toner below a predetermined threshold quantity. The signal processing unit 15 compares the output voltage $E_s$ of the toner quantity detector 4*c* with the warning voltage $E_{emp}$ ($E_{emp}'$) and the prewarning voltage $E_{nep}$ ($E_{nep}'$), and provides a warning signal EAL when the output voltage $E_s$ is not higher than the warning voltage $E_{emp}$ ($E_{emp}'$) or provides a prewarning signal NAL when the output voltage $E_s$ is not higher than the prewarning voltage $E_{nep}$ ($E_{nep}'$).

Thus, the warning voltage $E_{emp}$ ($E_{emp}'$) and the prewarning voltage $E_{nep}$ ($E_{nep}'$) are respectively set for each one of the toner quantity detector 4*c*, so that when any one of the warning voltages $E_{emp}$ ($E_{emp}'$) and the prewarning voltages $E_{nep}$ ($E_{nep}'$) is generated, the variation in the amount of can be suppressed and decreased even when the output characteristic of each detector is varied as shown by a curve A, B, C or D in FIG. 1(*b*) unique to the toner quantity detector 4*c*. Since it is possible to determine the warning voltage $E_{emp}$ ($E_{emp}'$) and the prewarning voltage $E_{nep}$ ($E_{nep}'$) so that the difference between the warning voltage $E_{emp}$ ($E_{emp}'$) and the prewarning voltage $E_{nep}$ ($E_{nep}'$) is relatively large, a time interval be the coincidence of the output voltage $E_s$ of the toner quantity detector 4*c* with the prewarning voltage $E_{nep}$ ($E_{nep}'$) and the coincidence of the same with the warning voltage $E_{emp}$ ($E_{emp}'$) is relatively long.

The warning voltage $E_{emp}$ ($E_{emp}'$) is determined by adding a first fixed value S1 to a minimum output voltage $E_{smin}$ of the toner quantity detector 4*c*, which is provided when the toner stirring unit 4*a* is removed from the image recording apparatus, and the prewarning voltage $E_{nep}$ ($E_{nep}'$) is determined by adding a second fixed value S2 (S2>S1) to the minimum output voltage of the toner quantity detector 4*c*.

The output voltage $E_s$ of the toner quantity detector 4*c* may be displayed on a display to facilitate the operator to determine the warning voltage $E_{emp}$ ($E_{emp}'$) and the prewarning voltage $E_{nep}$ ($E_{nep}'$) by operating a keyboard or the like. Thus, when the toner quantity detector 4*c* is replaced with a new toner quantity detector, a new warning voltage and a new prewarning voltage can readily be determined for the new toner quantity detector.

A toner quantity detecting system in a preferred embodiment according to the present invention incorporated into the image recording apparatus will be described in detail hereinafter.

Figure 2:
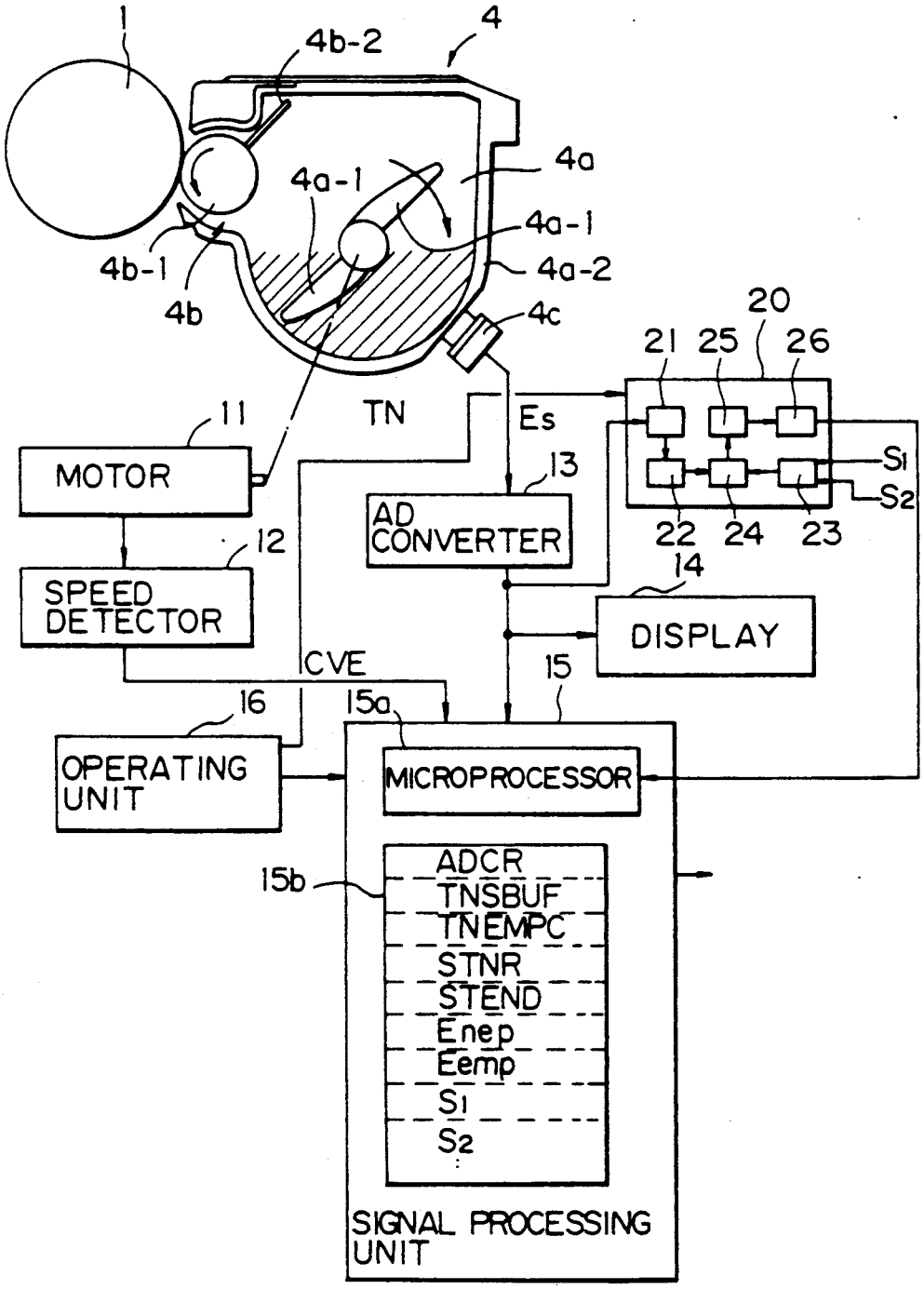
FIG. 2 is a block diagram of a toner quantity detecting system in a preferred embodiment according of the present invention.

Referring to FIG. 2 showing the general construction of the developing unit 4, the toner quantity detecting system comprises: the toner quantity detector 4*c* held on a the main frame of the image recording apparatus in contact with the outer surface of the toner container of either the toner storage unit or a toner stirring unit 4*a* detachably mounted on the main frame of the image recording apparatus; a toner output characteristic determining unit 20 determining an inherent output characteristic of the toner quantity detector 4*c* and determining the warning voltage $E_{emp}$ and the prewarning voltage $E_{nep}$; an AD converter 13 for converting the analog output signal of the toner quantity detector 4c into a proportional digital signal; and a signal processing unit 15 that compares the output voltage $E_s$ of the toner quantity detector 4c with the warning voltage $E_{emp}$ and the prewarning voltage $E_{nep}$ and determines the quantitative condition of toner in the toner container.

The toner output characteristic determining unit 20 comprises, as principal components, an output characteristic measuring device 21 for measuring the output characteristic of the toner quantity detector 4c, a first storage device 22 for storing the measured output characteristic of the toner quantity detector 4c, a second storage device 23 for storing the predetermined fixed values S1 and S2, an adder 24 for adding the fixed values S1 and S2 to the stable minimum output voltage $E_{smin}$ of the toner quantity detector 4c to determined the prewarning voltage $E_{nep}$, i.e., an upper reference voltage, and the warning voltage $E_{emp}$, i.e., a lower reference voltage, a third storage device 25 for storing the prewarning voltage $E_{nep}$ and the warning voltage $E_{nep}$ provided by the adder 24, and a fourth storage device 26 for storing a reference warning level and a reference prewarning level corresponding respectively to the warning voltage $E_{emp}$ and the prewarning voltage $E_{nep}$.

Referring again to FIG. 2, there are shown the photoconductive drum 1, the developing unit 4, a motor 11 for rotating a stirrer 4a-1, a speed detector 12 which detects the rotating speed of the motor 11 and provides a set speed signal CVE upon the coincidence of the rotating speed of the motor 11 with a set rotating speed, the AD converter 13, a display 14, such as a liquid crystal display, for displaying the output voltage $E_s$ of the toner quantity detector 4c, the signal processing unit 15, and a printer operating unit 16.

The stirrer 4a-1 of the toner stirring unit 4a of the developing unit 4 is rotated by the motor 11 to stir the toner TN contained in a toner container 4a-2. The toner feeder 4b has a magnet roller 4b-1 for transferring the toner TN to the photoconductive drum 1, and a doctor's blade 4b-2 for regulating the thickness of the layer of toner TN on the circumference of the magnet roller 4b-1. The toner quantity detector 4c is disposed in contact with the outer surface of the toner container 4a-2 of the toner stirring unit 4a. The toner quantity detector 4c provides an output voltage $E_s$ corresponding to the quantity of toner TN contained in the toner container 4a-2.

The signal processing unit 15 comprises a microprocessor 15a, a data memory 15b for storing data, and a program memory, not shown. The warning voltage $E_{emp}$, the prewarning voltage $E_{nep}$, and the fixed values S1 and S2 are stored in the data memory 15b.

A procedure of measuring the output characteristic of the toner quantity detector 4c will be described hereinafter.

Since the respective output characteristics of toner quantity detectors are different from each other, the output characteristic unique to the toner quantity detector 4c of the toner quantity detecting system must be measured and defined previously. As mentioned above, the output voltage $E_s$ of the toner quantity detector 4c is stabilized and variation thereof different detectors is small on the lowest level when the toner container 4a-2 is empty or contains a small amount of the toner. Therefore, the output characteristic of the toner quantity detector 4c is represented by meaning its minimum output voltage $E_{smin}$ provided when the developing unit 4 is separated from the main frame of the apparatus and by adding a predetermined first fixed value S1 to the minimum output voltage $E_{smin}$ measured to determine the warning voltage $E_{emp}$, and by adding a predetermined second fixed value S2 to the minimum output voltage $E_{smin}$ to determine the prewarning voltage $E_{nep}$. The minimum output voltage $E_{smin}$ is stored in the first storage device 22.

In separating the toner developing unit 4 from the developing unit 4, the toner quantity detector 4c fixedly provided on the developing unit 4 is removed therefrom or the detector is fixedly mounted on the main frame of the image recording apparatus and wherein the developing unit 4 is removably mounted on the main frame thereof to be removed from the image recording apparatus. In the latter case, the developing unit 4 is detachably mounted on the main frame of the image recording apparatus, and the toner quantity detector 4c is held fixedly on the main frame of the image recording apparatus, which facilitates the measurement of the output characteristic of the toner quantity detector 4c and enables the accurate connection of the toner quantity detector 4c and the developing unit 4.

The first fixed value S1 and the second fixed value S2 are read from the second storage device 23, the adder 24 calculates $E_{smin}+S1=E_{emp}$ and $E_{smin}+S2=E_{nep}$, and the warning voltage $E_{emp}$ and the prewarning voltage $E_{nep}$ thus calculated are stored in the third storage device 25. The first fixed value S1 and the second fixed value S2 are stored previously in the second storage device 23. For example, the first fixed value S1 is 0.6 V and the second fixed value S2 is 1.2 V.

Although there is no particular restriction on the predetermined first fixed value S1 and the second fixed value S2, the fixed values S1 and S2 must selectively be determined so that the lower reference voltage is not lower than the warning voltage $E_{emp}$ (FIG. 1) and the upper reference voltage is not higher than the prewarning voltage $E_{nep}$ (FIG. 1) when the toner quantity detector 4c has an output characteristic represented by the curve A or C, and the fixed values S1 and S2 must selectively be determined so that the lower reference voltage is not lower than the warning voltage $E_{emp}'$ (FIG. 1) and the upper reference voltage is not higher than the prewarning voltage $E_{nep}'$ (FIG. 1) when the toner quantity detector 4c has an output characteristic represented by the curve B or D.

Figure 3:
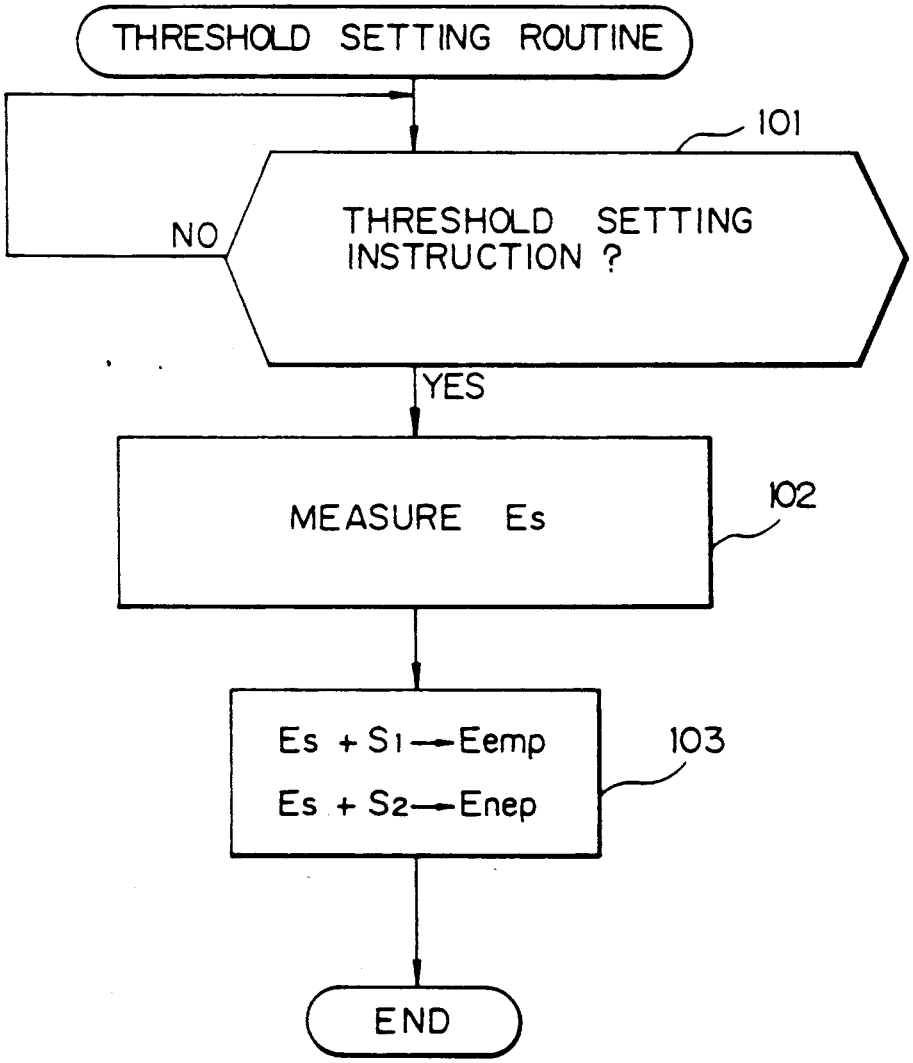
FIG. 3 is a flow chart explaining a method of determining a prewarning voltage and a warning voltage.

FIG. 3 is a flow chart showing steps of a reference voltage determining procedure for automatically determining the warning voltage $E_{emp}$ and the prewarning voltage $E_{nep}$.

In determining the warning voltage $E_{emp}$ and the prewarning voltage $E_{nep}$, the toner stirring unit 4a is removed from the main frame of the image recording apparatus.

Figure 4:
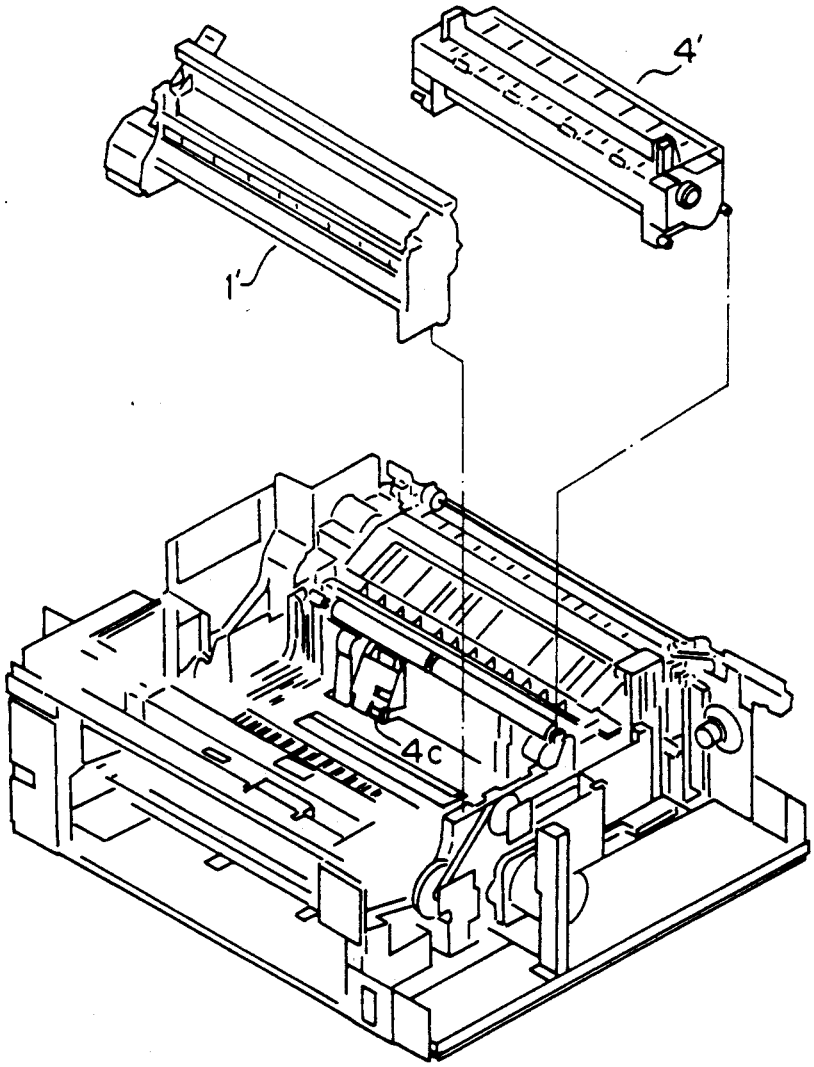
FIG. 4 is an exploded perspective view of an image recording apparatus when a toner stirring member is taken out.

In FIG. 4, the photoconductive drum unit 1' and the developing unit 4' including the toner stirring unit 4a are removed from the main frame of the image recording apparatus, and the detecting head of the toner quantity detector 4c is exposed. When there is not any metallic part in the vicinity of the toner quantity detector 4c, the output voltage of the toner quantity detector 4c when the toner is virtually exhausted is substantially equal to the output voltage of the same when the developing unit 4' is removed from the image recording apparatus.

A query is made in step 101 to see if an instruction requesting the determination of the warning voltage $E_{emp}$ and the prewarning voltage $E_{nep}$ is given by operating the operating unit 16. If the response in step 101 is affirmative, the reference voltage determining unit 20 reads the output voltage $E_s$ of the toner quantity detector 4c through the AD converter 13 in step 102.

The adder 24 of the output characteristic determining unit 20 reads the first fixed value S1 and the second fixed value S2 from the second storage device 23 and calculates the warning voltage $E_{emp}$ and the prewarning voltage $E_{nep}$ by using expressions:

$$E_{emp}=E_{smin}+S1 \quad (1)$$

$$E_{nep}=E_{smin}+S2 \quad (2)$$

in step 103, stores both results in a date memory 25 and then the stored date in the memory 25 are stored in the storage device 25 as the warning voltage $E_{emp}$ and the prewarning volta $E_{nep}$, respectively, before ending the reference voltage determining procedure.

Figure 5:
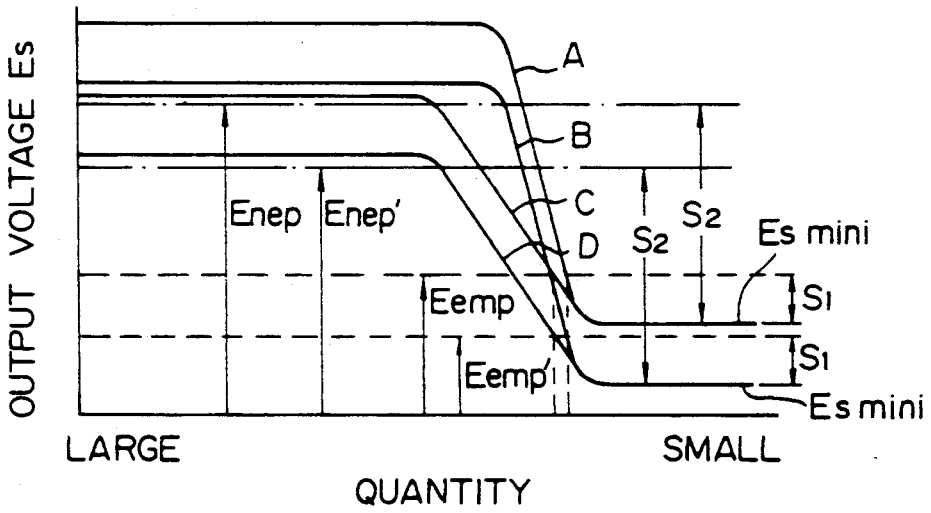
FIG. 5 is a graph explaining a method of determining a prewarning voltage and a warning voltage by a method of detecting the quantity of toner embodying the present invention.

The reference warning voltage and the reference prewarning voltage will be explained with reference to FIG. 5. The reference warning voltage and the reference prewarning voltage for the toner quantity detector 4c are $E_{emp}$ and $E_{nep}$ when the toner quantity detector 4c has an output characteristic represented by the curve A or C, and $E_{emp}'$ and $E_{nep}'$ when the toner quantity detector 4c has an output characteristic represented by the curve B or D.

Figure 6A:
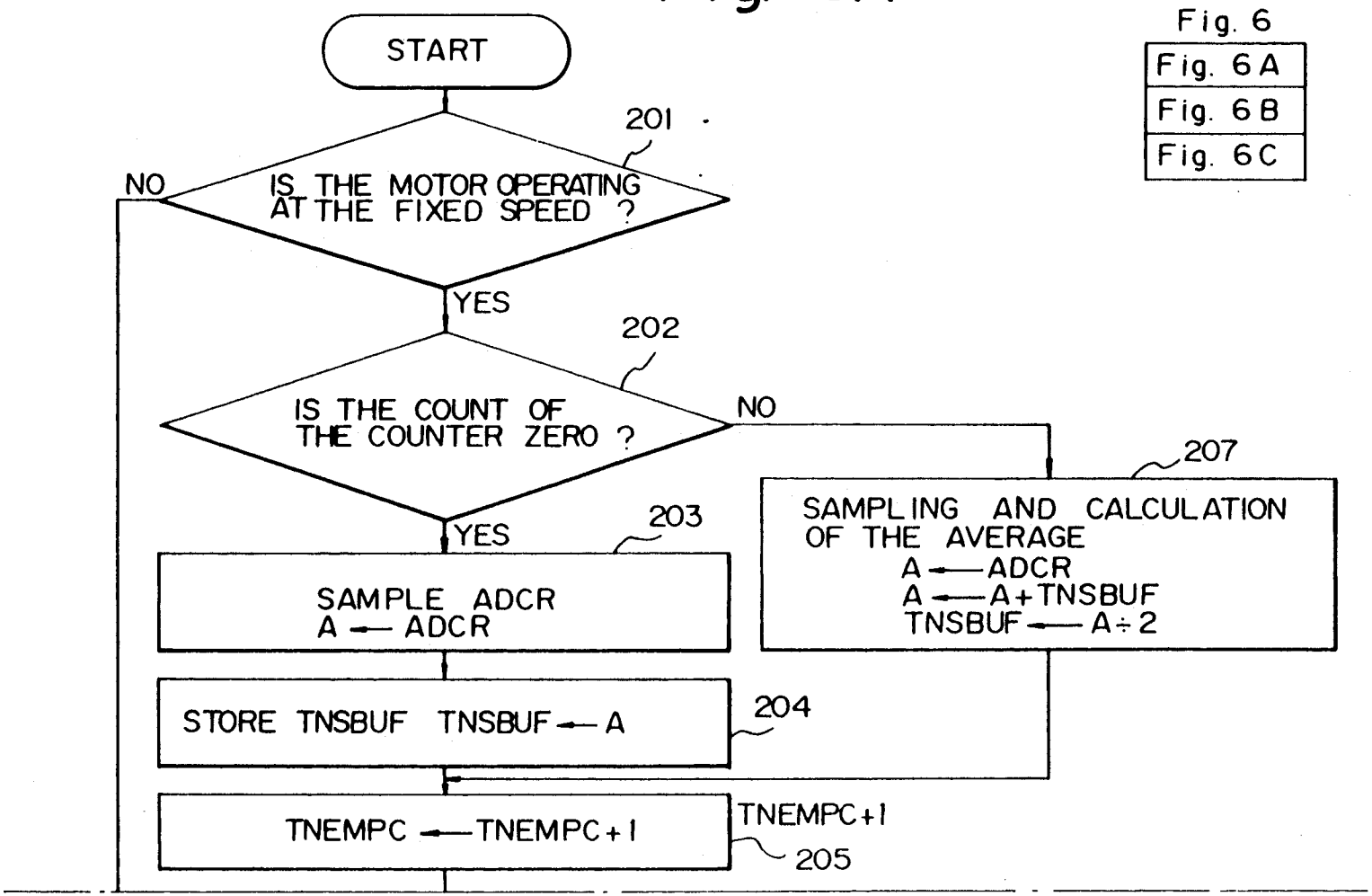
FIG. 6(A), 6(B) and 6(C) are a flow chart of a control program for detecting the quantity of toner.
Figure 6B:
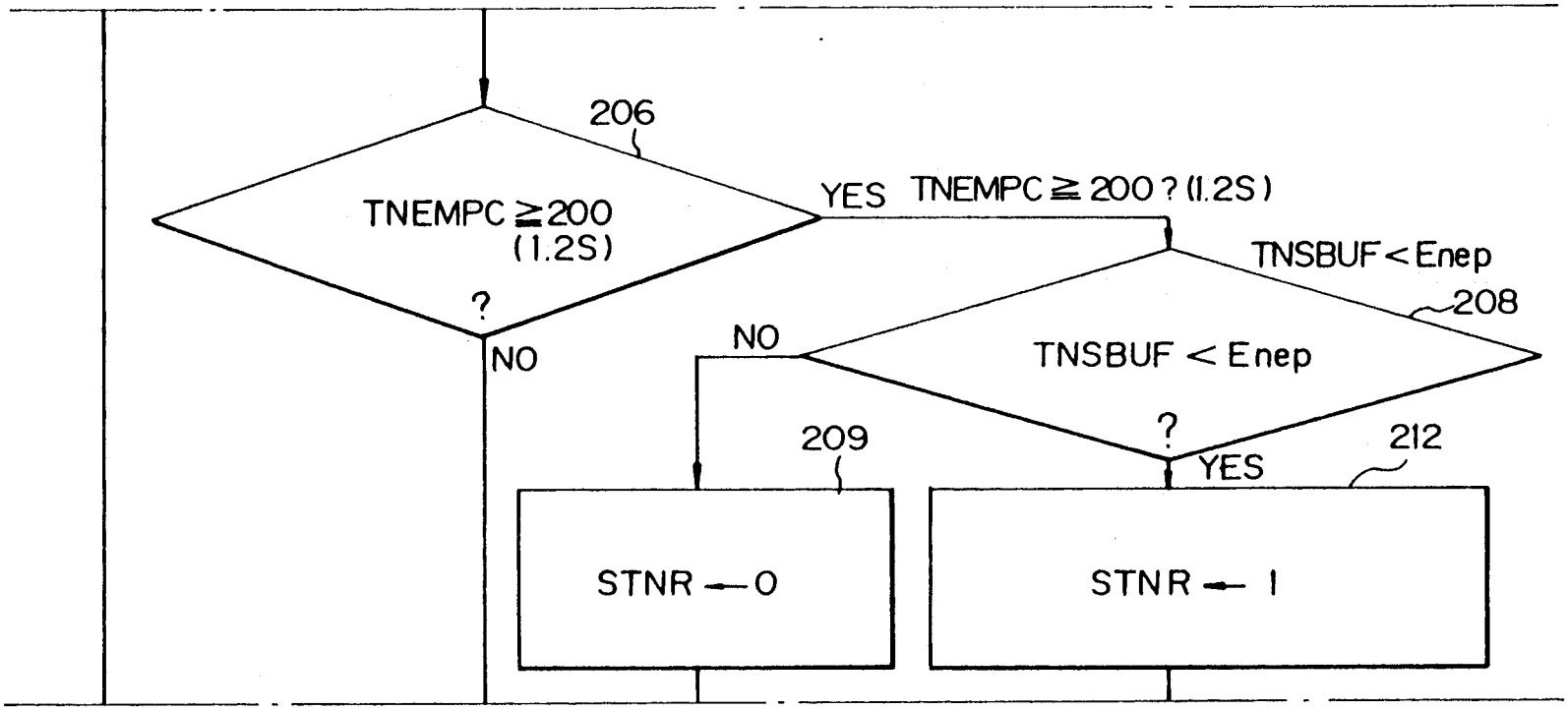
Figure 6C:
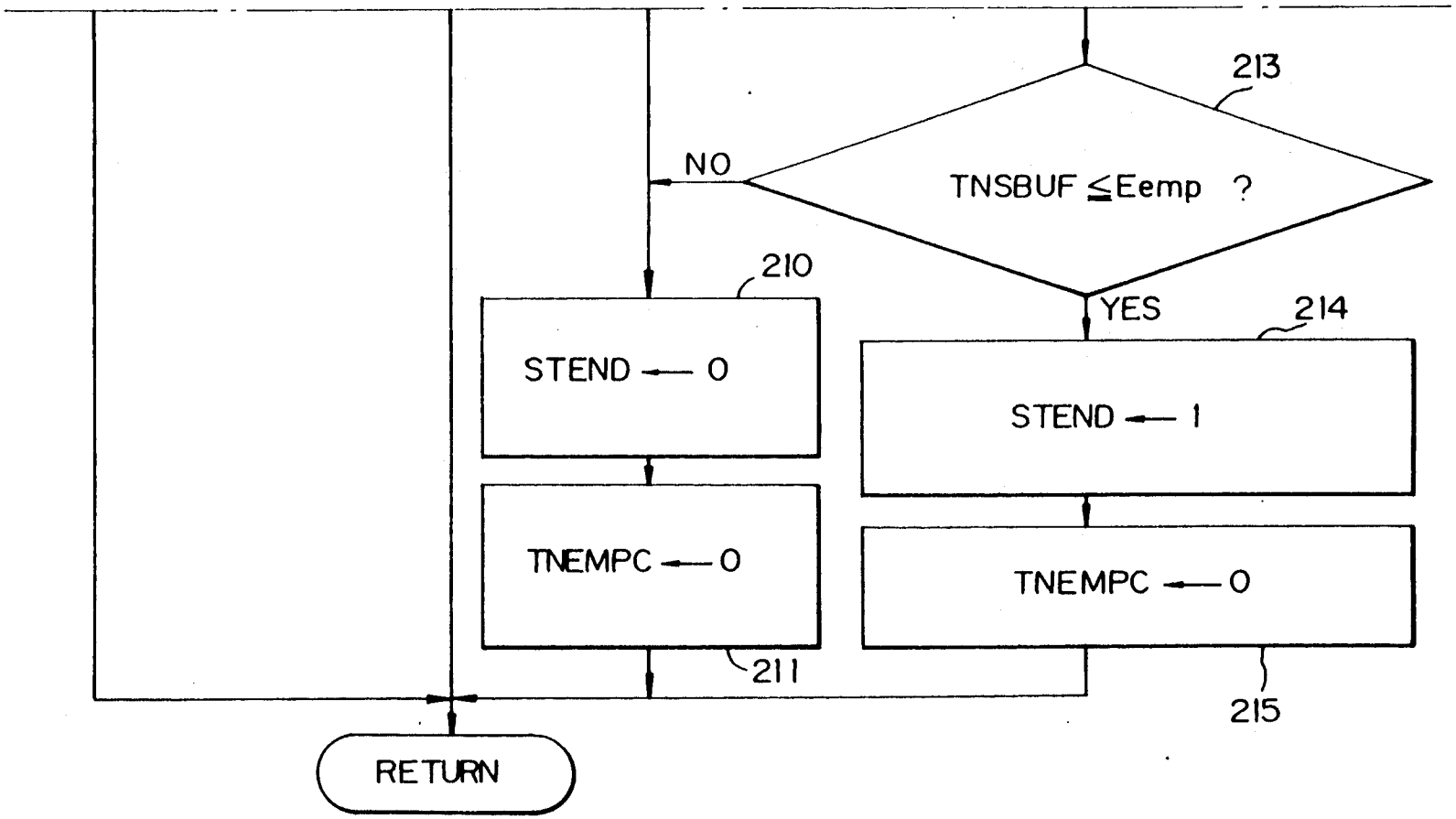
Figure 7:
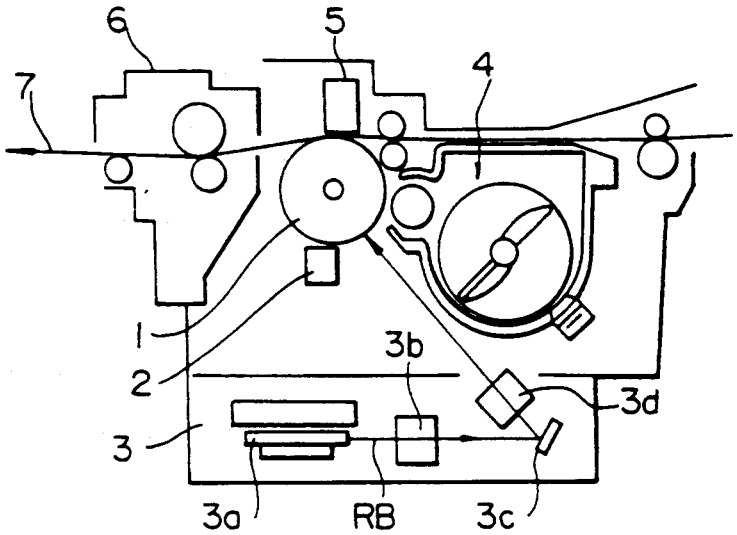
FIG. 7 is a schematic sectional view of an electrophotographic printer.

The operation of the toner quantity detecting system will be described hereinafter with reference to FIG. 6.

The period of sampling operation of the toner quantity detecting system, for example, 1.2 sec, is an integral multiple of a stirring period. Sampling rate is 200 cycle/1.2 sec.

The microprocessor 15a of the signal processing unit 15 monitors the rotating speed of the motor 11 continuously (step 201), and the speed detector 12 provides the set speed signal CVE. A query is made at a sampling time in step 202 to see if a count TNEMPC, which is zero in the initial state, stored in the data memory 15b is 0. In the initial state, the count TNEMPC is 0 and hence the response in step 202 is affirmative. In steps 203 and 204, the output A, of the AD converter is sampled and the output is stored in the data memory 15b as ADCR and TNSBUF, respectively.

In steps 205, the content of the counter is incremented by one (TNEMPC+1), and then a query is made in step 206 to see if the count of the counter is 200 or greater, if the sampling period is set at 1.2 sec or not. If the response in step 206 is negative, steps 201 to 206 are executed repeatedly.

If the response in step 202 is negative, namely, if the count of the counter is not 0, the output A, of the AD converter 13 is sampled at a sampling time and the output value A is stored as ADCR, and then TNSBUF, i.e., the quantity of toner, is updated by the following conversion formula namely, A←A+TNSBUF and TNSBUF←A/2, in step 207; that is, the moving average of data is calculated every time the output A of the AD converter 13 is sampled. Then, steps 205 and 206 are executed. Steps 201, 207, 205 and 206 are executed repeatedly until the count exceeds 200. The response in step 206 is affirmative when TNEMPC≧200.

In step 208 a query is made to see if TNSBUF representing the quantity of toner is smaller than the prewarning voltage $E_{nep}$. If the response in step 208 is negative, a prewarning flag STNR is reset to 0 in step 209, a warning flag STEND is reset to 0 in step 210, the content of the counter is cleared in step 211, and then the routine returns to step 201 to execute the same steps again.

As the toner is consumed with the progress of the image recording operation and TNSBUF representing the quantity of toner decreases gradually. Upon the decrease of TNSBUF below the prewarning voltage $E_{nep}$, the response in step 208 is affirmative. Then, the prewarning flag STNR is set to 1 to generate the prewarning signal NAL and to display a warning sign on the display.

In step 213, a query is made to see if TNSBUF is lower than the warning voltage $E_{emp}$. If the response in step 213 is negative, step 210 and the following steps are executed repeatedly. When the TNSBUF representing the quantity of toner is lower than the warning voltage $E_{emp}$, namely, when the quantity of toner remaining in the toner container is less than a lower threshold quantity, the response in step 213 is affirmative. Then, a warning flag STEND is set to 1 to generate the warning signal EAL and a warning sign is displayed on the display in step 214. Then, the count TNEMPC of the counter is cleared in step 215 and the procedure is repeated.

In this embodiment, the prewarning voltage $E_{nep}$ and the warning voltage $E_{emp}$ are determined on the basis of the output voltage of the toner quantity detector 4c in a state where the toner has virtually been exhausted. It is also possible to take into consideration the output voltage of the toner quantity detector 4c in a state where the toner container is filled with toner to its full capacity in determining the prewarning voltage $E_{nep}$ and the warning voltage $E_{emp}$, which reduces the variation of the quantity of toner from the lower threshold quantity corresponding to the warning voltage $E_{emp}$.

The residual quantity of the toner storage unit, instead of the quantity of the toner in the toner stirring unit, may be detected. In this case, the prewarning voltage $E_{nep}$ and the warning voltage $E_{emp}$ are determined on the basis of the output voltage of the toner quantity detector 4c provided when the toner storage unit is removed from the image recording apparatus.

Furthermore, although this embodiment determines the prewarning voltage $E_{nep}$ and the warning voltage $E_{emp}$ automatically, it is also possible to display the output voltage of the toner quantity detector 4c provided when the toner stirring unit is removed from the image recording apparatus on the display to make the operator set the prewarning voltage $E_{nep}$ and the warning voltage $E_{emp}$ by operating the operating unit 16 with reference to the output voltage of the toner quantity detector 4c displayed on the display 14.

Thus, the prewarning voltage $E_{nep}$ and the warning voltage $E_{emp}$ are determined on the basis of the output voltage of the toner quantity detector 4c in a specific state corresponding to the virtual exhaustion of toner, so that the prewarning voltage $E_{nep}$ and the warning voltage $E_{emp}$ correspond accurately to the desired quantities of toner remaining in the toner container, respectively.

Furthermore, since the difference, i.e., S−S2, between the prewarning voltage $E_{nep}$ and the warning voltage $E_{emp}$ is sufficiently large, sufficient time is available for replenishing the toner container with toner after the output voltage $E_s$ of the toner quantity detector 4c has coincided with the prewarning voltage $E_{nep}$ before the output voltage $E_s$ drops to the warning voltage $E_{emp}$.

Still further, since the present invention displays the output voltage of the toner quantity detector 4c on the display 14 to enable the operator to set the prewarning voltage $E_{nep}$ and the warning voltage $E_{emp}$ by operating the keyboard, the prewarning voltage $E_{nep}$ and the warning voltage $E_{emp}$ can readily be set when the toner quantity detector 4c is replaced with a new one.

The construction of the developing unit capable of enabling the toner quantity detecting system of the present invention to function effectively will be described hereinafter.

Incidentally, if toner TN accumulates on the inner surface of the toner container 4a-2 of the developing unit 4 particularly in an area corresponding to the toner quantity detector 4c, the toner quantity detector 4c is unable to detect accurately the quantity of toner TN remaining in the toner container 4a-2 and provide a warning when the quantity of toner TN decreases below a predetermined threshold value. Therefore, the developing unit 4 is designed so as to remove the toner adhering to the inner surface of the toner container 4a-2 to secure the accurate detection of the quantity of toner remaining in the toner container 4a-2. Preferably, the developing unit 4 is provided with a cleaning member capable of smoothly coming into contact with a wide area on the inner surface of the toner container 4a-2 and removing the toner adhering to the inner wall of the toner container 4a-2 in an area corresponding to the toner quantity detector 4c without applying shocks to the toner container 4a-2.

Figure 11A:
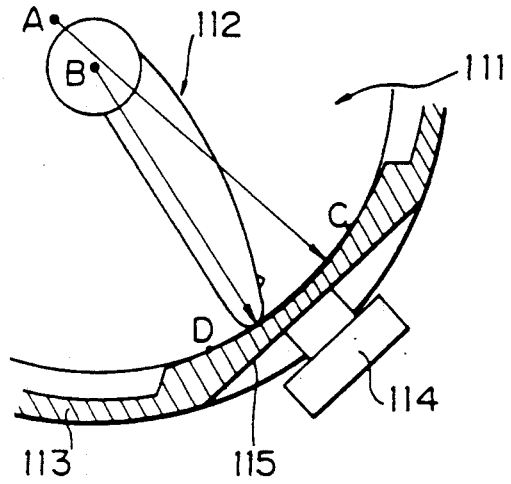
FIGS. 11(*a*) and 11(*b*) are fragmentary schematic sectional views of a developing unit combined with the toner quantity detecting system embodying the present invention.
Figure 11B:
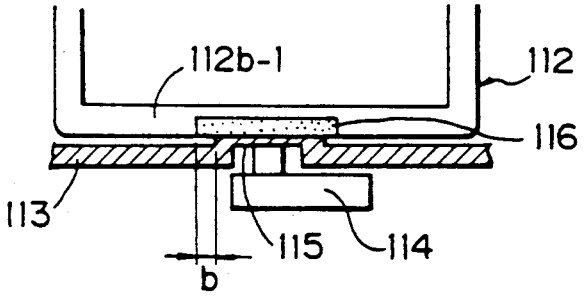

Referring to FIGS. 11(*a*) and 11(*b*) showing a developing unit suitable for use in combination with the toner quantity detecting system of the present invention, there are shown a toner stirring unit 111, a rotary stirring member 112 for frictionally charging the toner by stirring, a toner container 113, a toner quantity detector 114, which may be a toner density detector, a detector seat 115 on which the toner quantity detector 114 is seated, and a cleaning member 116 for cleaning a portion of the inner surface of the toner container 113 corresponding to the detector seat 115.

The inner surface of the detector seat 115 is raised on a circular inner surface from the inner surface of the toner container 113 so that the inner surface of the detector seat 115 interferes with the extremity 112b-1 of the toner stirring member 112. A recess of a width wider than the width of the circular inner surface of the detector seat 115 is formed in the extremity of the toner stirring member 112, and the cleaning member 116 is attached to the toner stirring member 112 in the recess so that its surface is substantially flush with the extremity 112b-1 of the toner stirring member 112. When the toner stirring member 112 is rotated, the cleaning member 116 wipes off the toner adhering to the circular inner surface of the detector seat 115 to enable the toner quantity detector 114 to detect the quantity of toner accurately.

The radius of a circle having a center A and corresponding to the circular inner surface of the detector seat 115 is equal to or slightly greater than the radius of a circle having a center B along which the extremity 112b-1 of the toner stirring member 112 moves, and the center A is dislocated from the center B away from the inner surface of the toner container 113 on a line passing the center B and the middle of the circular inner surface of the detector seat 115. Accordingly, the cleaning member 116 comes smoothly into contact with the circular inner surface of the detector seat 115 at a point C, the pressure acting between the cleaning member 116 and the circular inner surface of the detector seat 115 increases as the toner stirring member 112 rotates to enable the cleaning member 116 to remove the toner adhering to the circular inner surface of the detector seat 115, the pressure acting between the cleaning member 116 and the circular inner surface of the detector seat 115 decreases gradually as the toner stirring member 112 rotates further, and then the cleaning member 116 separates smoothly from the circular inner surface of the detector seat 115 at a point D. Thus, the cleaning member 116 is able to clean a wide area of the circular inner surface of the detector seat 115.

Figure 8:
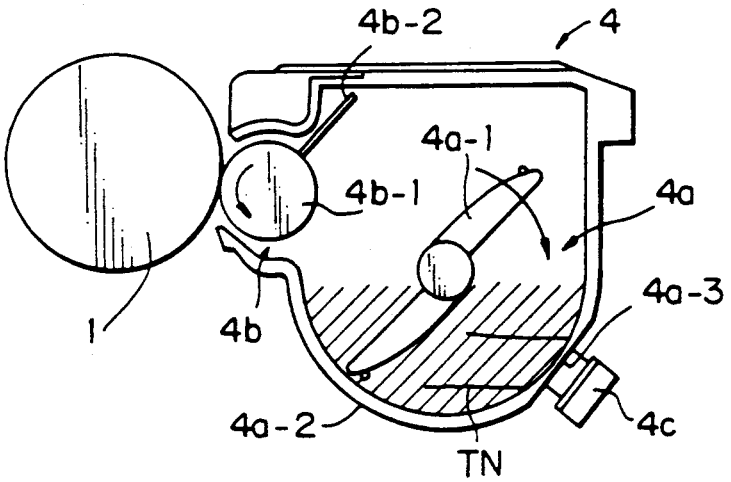
FIG. 8 is a schematic sectional view of a developing unit.
Figure 9A:
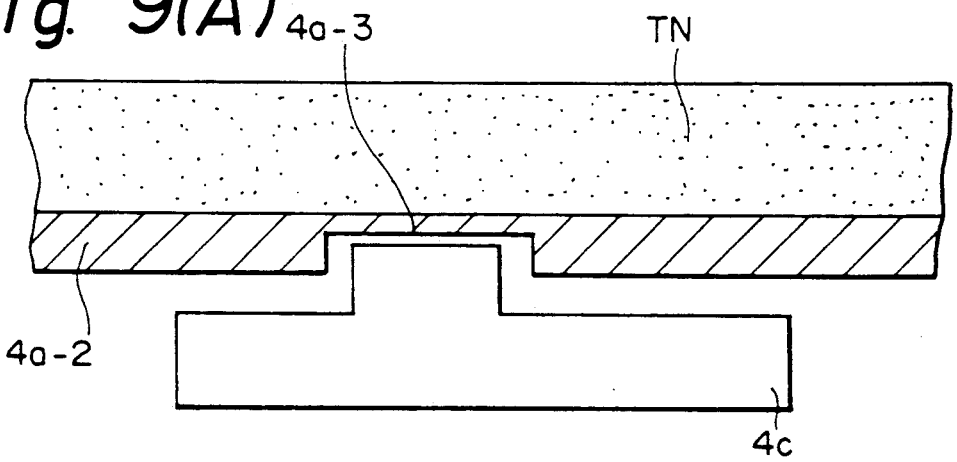
FIGS. 9(*a*), 9(*b*) and 9(*c*) are a fragmentary sectional view, a circuit diagram and a graph, respectively, in explaining a toner quantity detector.
Figure 9B:
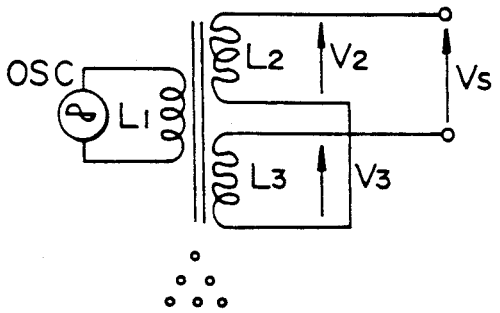
Figure 9C:
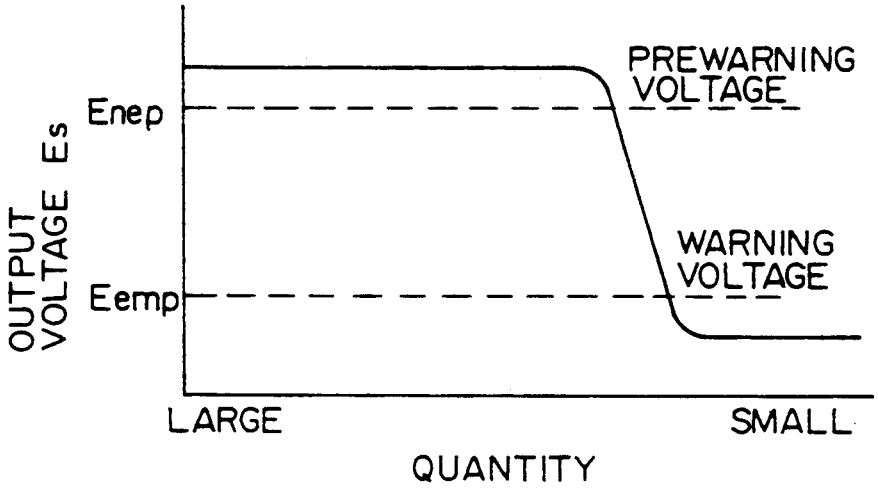
Figure 10:
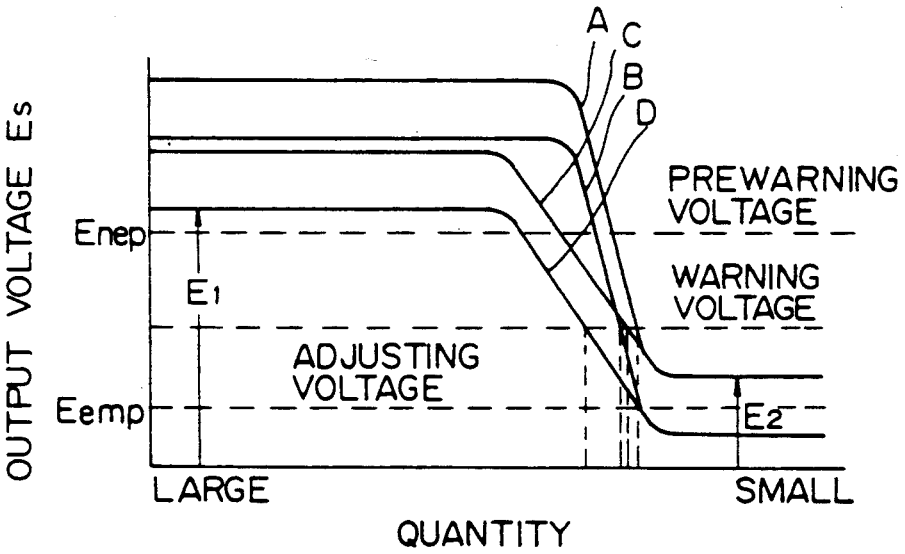
FIG. 10 is a graph showing the output characteristics of toner quantity detectors respectively having different properties.
Figure 12A:
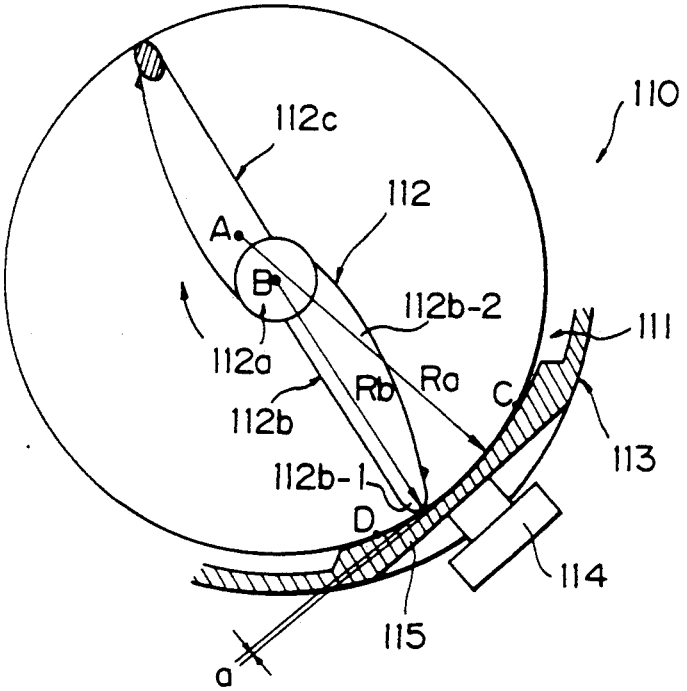
FIGS. 12(*a*) and 12(*b*) are fragmentary schematic sectional views of a developing unit combined with the toner quantity detecting system embodying the present invention.
Figure 12B:
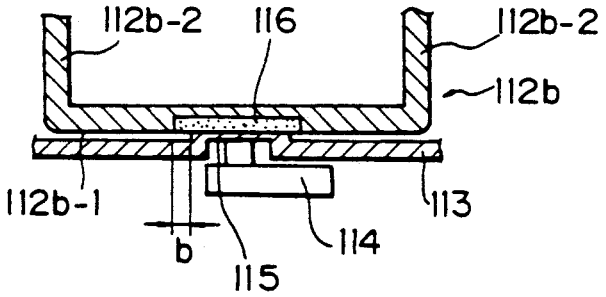

FIGS. 12(*a*) and 12(*b*) show another developing unit 110 incorporating the toner quantity detecting system of the present invention, in which parts like or corresponding to those of the developing unit shown in FIGS. 11(*a*) and 11(*b*) are denoted by the same reference characters. The construction of the developing unit 110 is substantially the same as that of the conventional developing unit shown in FIG. 8.

Referring to FIGS. 12(*a*) and 12(*b*), there are shown a toner stirring unit 111, a rotary toner stirring device 112 for frictionally charging the toner, a toner container 113, a toner quantity detector 114, which may be a toner density detector for detecting the quantity of toner contained in the toner container 113, a detector seat 115, and a cleaning member 116, such as a sponge pad, for removing the toner adhering to the circular inner surface of the detector seat 115.

Figure 13:
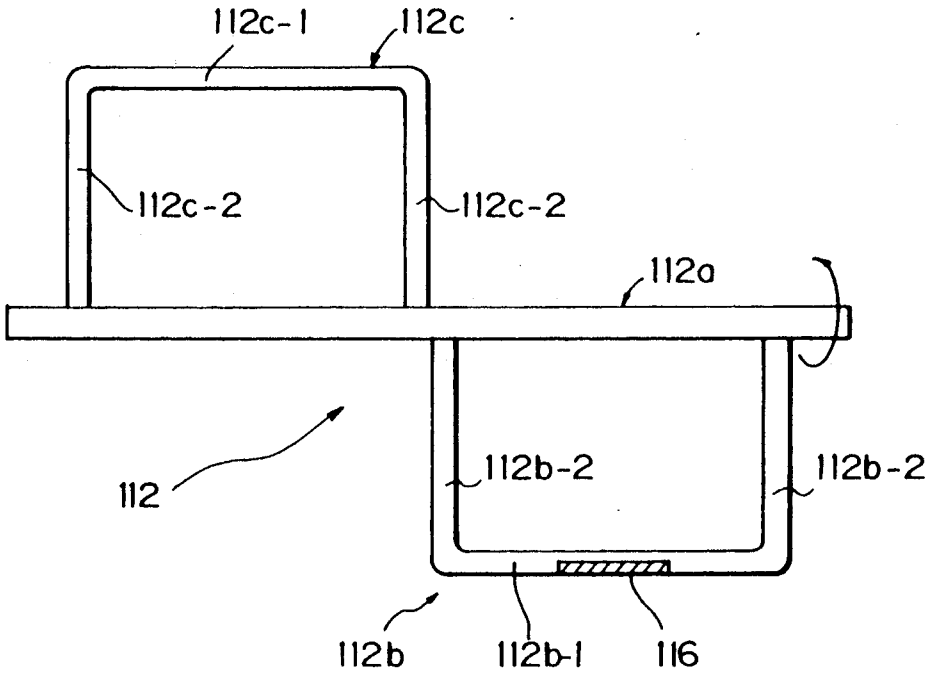
FIG. 13 is a plan view of a toner stirrer included in a developing unit combined with the toner quantity detecting system embodying the present invention.

As shown in FIG. 13, the toner stirring device 112 comprises a rotary shaft 112a, and two stirring members 112b and 112c having a shape substantially resembling the letter U and attached to the rotary shaft 112a. The stirring member 112b (112c) has arms 112b-2 (112c-2) radially projecting from the rotary shaft 112a and having a shape resembling a blade as shown in FIG. 12, and a stirring rod 112b-1 (112c-1) having a round cross section and held between the extremities of the arms 112b-2 (112c-2).

Figure 14A:
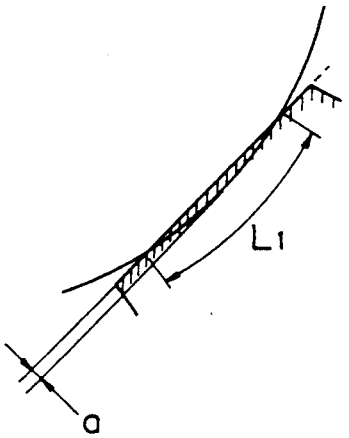
FIGS. 14(*a*) and 14(*b*) are fragmentary schematic sectional views explaining a cleaning range of a developing unit combined with the toner quantity detecting system embodying the present invention.
Figure 14B:
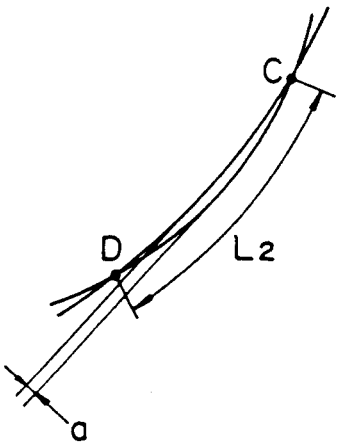

The inner surface of the detector seat 115 formed in the toner container 113 is raised in a circular inner surface as shown in FIG. 12(*a*). The radius Ra of a circle corresponding to the circular inner surface of the detector seat 115 is equal to or greater than the radius Rb of a circle along which the extremities of the toner stirring device 112 moves, and the center A of the circle having the radius Ra is dislocated from the center B of the circle having the radius Rb so that the circular inner surface of the detector seat 115 interferes with the stirring rod 112b-1 of the stirring member 112b by a maximum depth a of interference. If the inner surface of the detector seat 115 is flat as shown in FIG. 14(*a*), the cleaning member 116 is capable contacting a portion of the inner surface of a length L1. However, since the detector seat 115 has the circular inner surface as shown in FIG. 12(*a*), the cleaning member 116 is capable of contacting a portion of the circular inner surface of a length L2, which is greater than the length L1, as shown in FIG. 14(*b*).

A recess of a width wider than that of the circular inner surface of the detector seat 115 is formed on the surface of the stirring rod 112b-1 of the stirring member 112b facing the inner surface of the toner container 113, and a cleaning member 116 is attached adhesively to the stirring rod 112b-1 in the recess so that the surface of the cleaning member 116 is substantially flush with the surface of the stirring rod 112b-1 as shown in FIG. 12(*b*).

When the toner stirring device 112 is rotated, the cleaning member 116 is compressed between the stirring rod 112b-1 and the circular inner surface of the detector seat 115 and pressed firmly against the circular inner surface of the detector seat 115 to wipe off the toner adhering to the circular inner surface of the detector seat 115. The cleaning member 116 comes smoothly into contact with the circular inner surface of the detector seat 115 at a point C (FIG. 12(*a*)), is compressed gradually by a thickness corresponding to the maximum depth a of interference as the toner stirring device 112 rotates, is allowed to expand gradually after the same has been compressed by the thickness corresponding to the maximum depth a of interference, and then separates smoothly from the circular inner surface of the detector seat 115 at a point D (FIG. 12(*a*)) after wiping off the toner adhering to the circular inner surface of the detector seat 115. Consequently, the toner quantity detector 114 is capable of detecting the quantity of toner accurately. Since the cleaning member 116 is able to come smoothly into contact with the circular inner surface of the detector seat 115 and separate smoothly from the circular inner surface of the detector seat 115, no shock is applied to the developing unit 110; the circular inner surface of the detector seat 115 is not damaged and the stirring member 116 is not broken.

Although the invention has been described in its preferred form with a certain degree of particularity, obviously many changes and variations are possible therein. It is therefore to be understood that the present invention may be practiced otherwise than as specifically described herein without departing from the spirit and scope thereof.

We claim:

1. A toner quantity detecting system used in an image recording apparatus, comprising:

a main frame;

a photoconductive drum supported for rotation on the main frame;

charging means for charging a circumference of the photoconductive drum;

electrostatic latent image forming means for forming an electrostatic latent image on the circumference of the photoconductive drum;

developing means for developing the electrostatic latent image with toner to form a toner image, having a toner storage unit and a toner stirring unit, at least one of the toner storage unit and the toner stirring unit being detachably mounted on the main frame;

transfer charging means for charging a recording medium so that the toner image is transferred from the photoconductive drum to the recording medium;

fixing means for fixing the toner image to the recording medium;

toner quantity detecting means provided on a predetermined position of said main frame and being brought into contact with an outer surface of a toner container of at least one of said toner storage unit and said toner stirring unit, for generating an analog output based on a toner quantity of the toner container;

output characteristics determining means for determining an inherent output characteristic of the toner quantity detecting means by measuring an analog output of said toner quantity detecting means under a condition in which at least one of said toner storage unit and said toner stirring unit is removed from said main frame, and by adding a first predetermined fixed value and a second predetermined second fixed value which is larger than said first predetermined fixed value, to said analog output obtained under the condition in which at least one of said toner storage unit and said toner stirring unit is removed from said main frame, to obtain a first threshold voltage value for warning of a toner empty condition and a second threshold voltage value for prewarning of a toner near-empty condition, respectively;

an AD converter for converting the analog output of said toner quantity detecting means to a proportional digital value; and discriminating means for discriminating a condition of a current quantity of said toner in said toner container by comparing the proportional digital value from said AD converter, with said first and second threshold values, respectively.

2. A toner quantity detecting system according to claim 1, wherein said output characteristic determining means comprises measuring means for measuring the inherent output characteristic of the toner quantity detecting means as a voltage of minimum and stable value under a condition in which at least one of said toner storage unit and said toner stirring unit are removed from said main frame;

first storage means for storing the measured output characteristic of the toner quantity detecting means measured when at least one of said toner storage unit and said toner stirring unit is removed from said main frame, second storage means for storing the first predetermined fixed value and the second fixed value; and third storage means for storing a first sum of the first predetermined fixed value and the minimum and stable voltage output from the toner quantity detection means in accordance with the output characteristic curve thereof, and a second sum of the second predetermined fixed value and the minimum and stable voltage output from the toner quantity detection means; and fourth storage means for storing the first sum as a warning voltage and the second sum as a prewarning voltage.

3. A toner quantity detecting system according to claim 1, further comprising:

average calculating means for sampling a plurality of analog outputs of the AD converter to generate sampled outputs, and for calculating an average of the sampled outputs of the AD converter to generate an averaged output;

comparing means for comparing the averaged output of the average calculating means with the prewarning voltage and the warning voltage;

first warning means for generating a prewarning signal prompting an operator to replenish the toner container with toner when the averaged output is lower than the prewarning voltage, and second warning means for generating a warning signal warning the operator of a virtual exhaustion of the toner when the averaged output is lower than the warning voltage.

4. An apparatus for use with an image recorder, comprising:

a toner quantity detecting sensor provided at a predetermined position of said main frame, for generating an output voltage based on a residual amount of the toner existing in the toner container and being brought into contact with an outer surface of the toner container of at least one of the toner storage unit and the toner stirring unit, the output voltage being used to determine whether the toner container is in one of a toner empty condition and a toner near-empty condition, an output characteristic of said toner quantity detecting sensor being measured in advance of using said image recorder, a first threshold detecting voltage for detecting a toner empty condition and a second threshold detecting voltage for detecting a toner near-empty condition being set with respect to the output characteristic, and at least one of the toner empty condition and the toner near-empty condition being detected by comparing the output voltage with at least one of said first and second threshold voltages, respectively.

5. An apparatus according to claim 4, wherein the output voltage of the toner quantity detecting sensor is displayed on a display.

6. A method of detecting the quantity of toner according to claim 4, comprising steps of: sampling a predetermined number of outputs of the AD converter; calculating the average of the sample outputs of the AD converter by an average calculating means; comparing the average calculated by the average calculating means with the prewarning voltage; comparing the average calculated by the average calculating means with the warning voltage; generating a prewarning signal when the average calculated by the average calculating means is lower than the prewarning voltage; and generating a warning signal when the average calculated by the average calculating means is lower than the warning voltage.

7. A method of detecting a quantity of toner existing in a toner container used in an image recording apparatus including a main frame, a photoconductive drum supported for rotation on the main frame, a charger for charging a circumference of the photoconductive drum, an electrostatic latent image former for forming an electrostatic latent image on the circumference of the photoconductive drum, a developer for developing the electrostatic latent image with toner to form a toner image, and having a toner storage unit and a toner stirring unit, at least one of the toner storage unit and the toner stirring unit being detachable mounted on the main frame, a transfer charger for charging a recording medium so that the toner image is transferred form the photoconductive drum to the recording medium, a fixer for fixing the toner image to the recording medium, and a toner quantity detector for generating an output voltage based on an output characteristic voltage and the quantity of the toner in the container, said method comprising the steps of:

measuring the output characteristic voltage of the toner quantity detector under a condition of at least one of said toner storage unit and said toner stirring unit being removed from said main frame, the output characteristic voltage being a minimum and stable value thereof;

storing the measured output characteristic voltage in a first storage unit;

storing a first predetermined fixed value and a second predetermined fixed value greater than the first predetermined fixed value, in a second storage unit;

storing a first sum of the said first predetermined fixed value and said output characteristic voltage and a second sum of said second predetermined fixed value and the output characteristic voltage, in a third storage unit;

storing the first sum as a first threshold voltage level for a warning voltage representing said toner empty condition and the second sum of the second predetermined fixed value and the output characteristic voltage as a second threshold voltage for a prewarning voltage representing said toner near-empty condition in a fourth storage unit;

detecting said output voltage of said toner quantity detector; and comparing said output voltage with at least one of said first and second threshold levels to determine whether the current toner residual amount is in at least one of an empty condition and a near-empty condition, respectively.

8. A method of detecting the quantity of toner according to claim 7, further comprising the steps of: displaying the output voltage of the toner quantity detector on a display.

9. A developer used in an image recording apparatus including a main frame, a photoconductive drum supported for rotation on the main frame, a charger for charging a circumference of the photoconductive drum, an electrostatic latent image former for forming an electrostatic latent image on the circumference of the photoconductive drum, a developer for developing the electrostatic latent image with toner to form a toner image, a transfer charger for charging a recording medium so that the toner image formed on the circumference of the photoconductive drum is transferred to the recording medium, and a fixer for fixing the toner image to the recording medium, said developer being used with a toner container, said developer comprising:

a toner stirring portion with a rotating stirring member for stirring toner container in the toner container to charge the toner frictionally, and a toner sensor provided on said toner stirring portion so that at least one of a toner empty condition, a toner near-empty condition and a toner concentration can be detected based on an output voltage of said toner sensor, a portion of said main frame to which said toner sensor is contacted, is projected inwardly into an inside of said toner container to form a detector seat so that said projected portion interferes with an extremity of said stirring member, and a recess of a width greater than a width of said projected portion in which said toner sensor being provided at the extremity of the stirring member so that the stirring member is able to rotate without colliding against the projected portion of said main frame, and a cleaning member being attached to said stirring member so that a surface of the cleaning member is substantially flush with the extremity of the stirring member.

10. A developer according to claim 9, wherein an inside configuration of said projected portion projecting inwardly inside said toner container and with a surface cleaned with said cleaning member provided n said extremity portion of said stirring member, is framed in a curvature having a radium equal to or greater than a radius of a circle along which said extremity of said stirring member rotates while a center of said curvature is eccentrically disposed from a center portion of said circle along which said extremity of said stirring member rotates.

* * * * *